US005337727A

United States Patent [19]

Borens et al.

[11] Patent Number: 5,337,727

[45] Date of Patent: Aug. 16, 1994

[54] WINDOW FOR A DEVICE WITH ELEVATED INNER CHAMBER TEMPERATURE

[75] Inventors: Manfred Borens, Stadecken-Elsheim; Dietrich Busch, Simmern; Roland Leroux, Stadecken-Elsheim; Regina Scheidler, Mainz; Karsten Bonzelius, Mainz-Mombach, all of Fed. Rep. of Germany

[73] Assignee: Schott Glaswerke, Mainz, Fed. Rep. of Germany

[21] Appl. No.: 37,630

[22] Filed: Mar. 26, 1993

[30] Foreign Application Priority Data

Mar. 25, 1992 [DE] Fed. Rep. of Germany ..... 4209622

[51] Int. Cl.[5] ..... F23M 7/00

[52] U.S. Cl. ..... 126/200; 126/198; 428/34; 52/788

[58] Field of Search ..... 126/200, 198; 52/788, 52/790; 359/614; 428/34

[56] References Cited

U.S. PATENT DOCUMENTS

| | | | |
|---|---|---|---|
| 2,394,176 | 2/1946 | Hillebrand | 126/200 |
| 2,536,956 | 1/1951 | Reeves | 126/200 |
| 2,794,434 | 6/1957 | Evans | 126/200 |
| 3,898,977 | 8/1975 | Draper | 126/200 |
| 4,033,321 | 7/1977 | Krebs | 126/198 |
| 4,043,091 | 8/1977 | Katona | 126/200 |
| 4,253,286 | 3/1981 | Katona | 126/200 |
| 4,898,147 | 2/1990 | Doni et al. | 126/200 |
| 5,107,821 | 4/1992 | Von Blanquet | 126/19 |

FOREIGN PATENT DOCUMENTS

| | | |
|---|---|---|
| 1019451 | 11/1957 | Fed. Rep. of Germany . |
| 7706648 | 6/1977 | Fed. Rep. of Germany . |
| 3602455 | 7/1987 | Fed. Rep. of Germany . |

*Primary Examiner*—Carroll B. Dority
*Attorney, Agent, or Firm*—Michael D. Bednarek

[57] ABSTRACT

In a window for ovens, in particular household baking ovens, with a window structure that consists of several panes (10, 28, 32), at least one of the panes (28) is angled in comparison to the other panes (10, 32). Because of this a lower outer surface temperature results on the outer pane (32) of the multiple pane arrangement turned away from the oven inner chamber (12) with elevated temperature. The frame (16, 34) of the multiple pane arrangement can also have openings (36) on the top and bottom in the area between the outside pane (32) and the center pane (28). In combination with this measure, which permits convection of the outside air through the outer pane intermediate space (arrows 38), an additional reduction of the temperature of the outer pane (32) can be achieved. This air convection can be increased by the fact that the angled center pane (28) converges toward the outer pane (32) at the top.

15 Claims, 2 Drawing Sheets

WINDOW FOR A DEVICE WITH ELEVATED INNER CHAMBER TEMPERATURE

FIELD OF THE INVENTION

The invention relates to a window for a device with elevated inner chamber temperature, particularly for a household roasting or baking oven generally with an arrangement, of at least two panes of glass, glass ceramic or a corresponding transparent and temperature-resistant material held by a common frame and positioned at a distance from each other.

BACKGROUND OF THE INVENTION

Windows of the type involved are generally well known, as a rule they are mounted in the front doors of baking ovens or the like. The following description is of household baking ovens, although the invention is also useful for any other device that has a window which separates an inner chamber with elevated temperature from the outer environment and through which a view from the outside into this chamber with elevated temperature is possible.

In contrast to the other walls surrounding an inner chamber with elevated temperature, in the case of windows it is not possible to apply an effective heat insulation, for example on the basis of mineral wool or the like. Therefore it is just these windows that have the problem of heating up too much on the outside. In order to decrease the external temperature of a window, in general multiple-pane arrangements are already in use, in which the inner side of the outer pane no longer contacts the chamber with elevated temperature directly, so that heating of the outer pane by direct heat transfer is already prevented. Still, with several panes at a distance from each other with air spaces separating them, the outside pane heats up by radiation from the inner chamber with elevated temperature, whereby this radiation affects, in part, the inner panes and is absorbed directly by the outside pane, but in part is also absorbed by the inner panes which then in turn transmit heat radiation to the next pane via the air-filled intermediate space by heat conduction and convection.

There are also versions of windows known in which an external pane is held at a distance from the other panes in such a way that the frame of the arrangement is open at least on the top and the bottom between the outside pane and the next inward pane so that between this outside pane placed in front and the next inner pane air convection can take place in the ambient chamber outside the device whereby for one thing the air that heats up between the two outer panes is exchanged by circulation of the ambient air and for another thing the outer pane placed in front is continuously cooled by this air stream.

There is also the possibility of using thermochrome panes inside, the radiation permeability of which is reduced as the temperature increases. However, this impairs the view through the window.

Providing one or more of the panes of a multi-pane arrangement with a coating is also known, which either reflects infrared radiation or decreases the emission of infrared radiation. A coating that exhibits one of these two properties is a coating of tin dioxide, for example. If it is applied on the inner side of a pane that is turned toward the chamber with elevated temperature, it reflects a part of the infrared radiation back into the inner chamber, it decreases the infrared radiation to the outside to the next outer pane. The panes can also be coated on both sides.

In spite of the provisions explained above, it is not unusual in household baking ovens that are operated at temperatures of 400° C. to 450° C. and above, especially with self-cleaning by pyrolysis, that the outer panes of a window are elevated to a temperature of up to about 150° C. In order to ensure safety when the window is touched by an operator, there is an effort in the relevant standards to limit the maximum permissible external temperature of such windows to 80° C.

SUMMARY OF THE INVENTION

Thus the invention is directed to methods by which a further decrease is possible in the external temperature of windows in operation, particularly in household baking ovens.

During intensive testing, it was surprisingly determined that, in a multi-pane arrangement of the window, placing at least two of the windows at an acute angle to each other can notably contribute to the reduction of the external temperature of windows for an oven chamber or the like. In part, this measure can be effectively combined with the known methods.

In fact, two-pane arrangements for heat insulating windows are not the optimum solution, but in its simplest form, the invention can be implemented by placing the two panes at an angle to each other, independently of whether one of the two windows lies in the imaginary plane of the window, i.e. generally vertical and the other pane is tilted in comparison to this vertical pane, or whether both panes are tilted slightly in comparison to the imaginary plane of the window and form an acute angle to each other. The angle of inclination is naturally limited in construction by a reasonable total thickness of the viewing pane arrangement and effectively lies between 0.5° and 10°, preferably in a range between 2° and 6°.

Preferably the panes that enclose the angles of inclination to each other are arranged in such a way that the inclination of the panes to each other runs in vertical direction. Depending upon the application, the panes can converge at the top or diverge at the top.

Depending on the version of the window, the temperature reducing effect of the angle position presumably occurs because of a certain course of the radiation and possibly also because of improved convection.

In contrast to parallel panes, between which a back and forth radiation of heat generally runs perpendicular to the pane surface, it appears that between two angled panes a back and forth radiation develops that progresses, according to the law of reflection, to the divergent area between the panes until it is absorbed by the frame of the pane arrangement on the divergent side of the panes. The heat conduction in the window frame is manageable. In the invention, it is simply a matter that the outer surface temperature of the outer pane of a multi-pane arrangement is reduced.

If the two panes that are placed at an angle to each other are enclosed in a solid frame, it is effective to arrange the panes in the position that is divergent toward the top since in this process the heat conduction in the window frame can still be supported on the divergent side of the panes, possibly by convection of the air in the enclosed space between the panes. However, if a different arrangement is used in which, as described in the state of the art, an outer pane is placed in front of the rest of the pane arrangement in such a way that air convection can take place in the surrounding area between this outer pane and the remaining pane arrangement, then it can be effective to arrange the outer pane placed in front and the next inner pane that is angled to it such that both panes converge toward the top, whereby an accelerated convection flow can be created by the reduction in distance of the panes at the top.

In the arrangement of the panes, it may also be necessary to make sure that the innermost pane turned toward the chamber with elevated temperature is not cooled too greatly if a certain temperature of the inner wall of the window is to be maintained. Cooling on the inner pane that is too great can also be disadvantageous if a cleaning of the baking oven through pyrolysis takes place, which in general is done between 400° and 450° C.

With a standard three-pane arrangement, in which all three panes are held fast in a common frame, the arrangement of the panes according to the invention is carried out advantageously in that the outer and inner pane run parallel to each other in one direction of an imaginary window plane and the pane that is arranged between these parallel panes is mounted so that it converges toward the inner pane at the top. If there is a convection-ventilated inner space between the outer pane and the angled center pane, the arrangement is advantageously carried out in the opposite way, in that the center, angled pane converges toward the outer pane at the top.

A window with four panes arranged in a fixed frame is advantageously designed such that the innermost and the outermost pane run parallel to each other as in the three-pane arrangement and the two center panes are at an angle both to each other and to the outer panes and diverge at the top.

It is advantageous to provide at least some of the panes with an infrared radiation reflecting coating and/or a coating that reduces infrared radiation emissions. On which side of a pane the coating should be applied depends on the arrangement and can be determined according to effectiveness. So in a three-pane arrangement, in which the two outer panes diverge at the top, it can make sense to provide an appropriate coating on the outside of the angled center pane so that it radiates less heat into the intermediate space toward the outermost pane, the heat then being conducted upward in the frame by reflecting back and forth in the intermediate space. Coating the outermost pane on the outside does not make sense. If it is coated on the inside it reflects a higher percentage of heat radiation into the intermediate space back to the center angled pane, whereby it heats up less itself; if it is coated on the outside, it radiates less heat toward the outside, whereby a higher percentage of heat is radiated back toward the inside. The innermost pane, if it is not supposed to drop below a certain temperature, should be coated only on the outside so that less heat is radiated to the outside to the next outward pane.

BRIEF DESCRIPTION OF THE DRAWINGS

The invention is explained in more detail below with reference to the enclosed drawings using the preferred embodiment examples in which.

DETAILED DESCRIPTION

Figure 1:
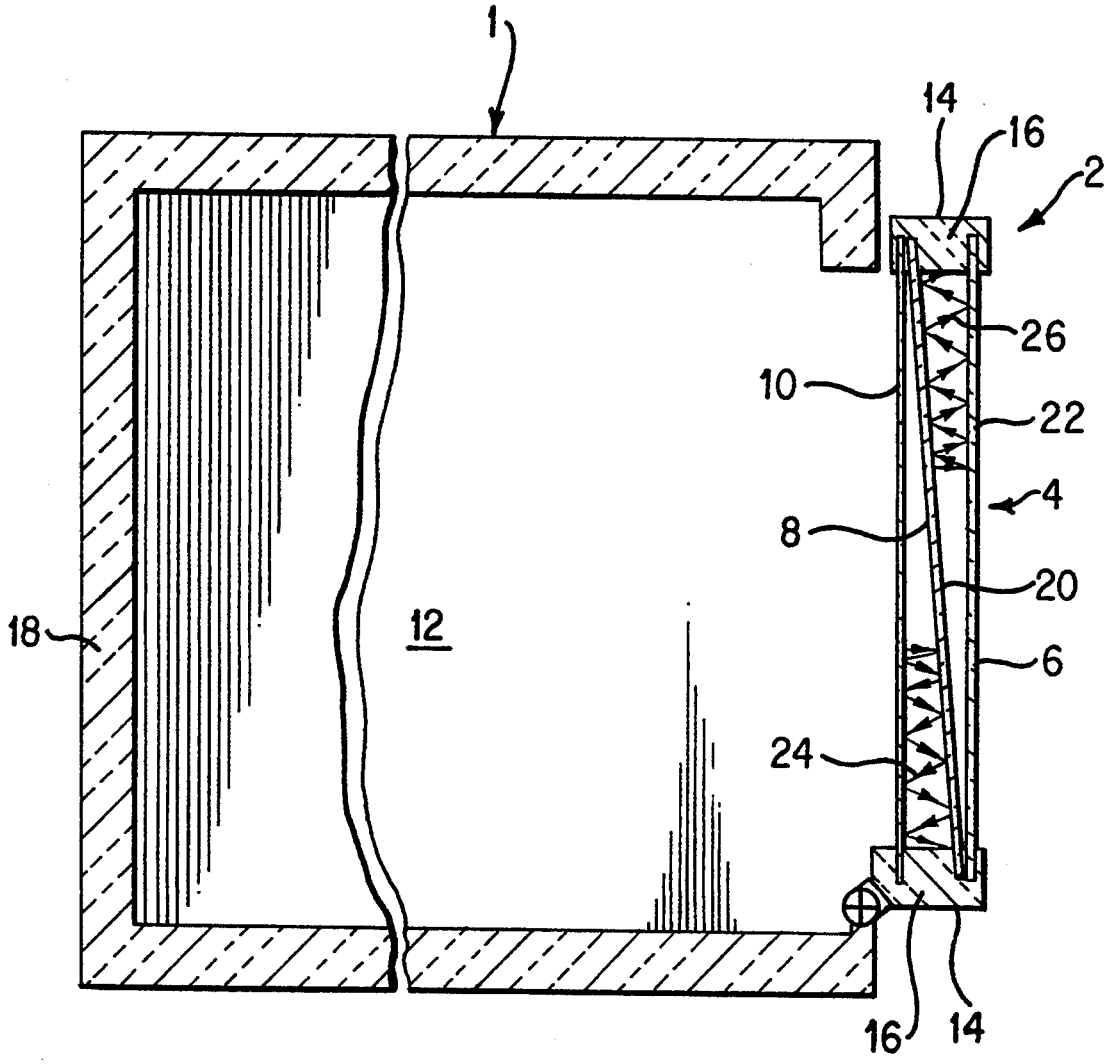
FIG. 1 is a schematic cross section through a baking oven with a front door having a window with three-pane layout, in which the center pane diverges outward at the top.

FIG. 1 shows, schematically, the cross section through a baking oven housing 1, used as an example, which can be closed by a flap door 2 on the front opening on the right side of the illustration, which is basically designed as a window 4. The window 4 exhibits a three-pane layout that consists of an outer pane 6, a center pane 8 and an inner pane 10 turned toward the chamber 12 with elevated temperature within the baking oven housing 1. The panes 6, 8 and 10 are held in a common frame 14, in which they can be embedded by means of a heat-resistant or even heat insulating material 16. Also, the baking oven housing 1 is, as usual, insulated to the outside against heat loss by means of a heat insulating material 18, for example a mineral wool.

As can be seen in the drawing, the center pane 8 is tilted at an acute angle to the other panes 6 and 10 that otherwise run parallel to each other, in such a way that the center pane 8 diverges from the outside pane 6 at the top. The angle of inclination in the embodiment example is about 4.5°. The center pane 8 is coated on its outside with a fluoridated tin dioxide coating 20, while the outermost pane 6 has such a coating 22 on its inside.

The inner pane 10 that is heated up by the chamber 12 with elevated temperature also radiates heat in the direction of the center pane 8, which thereby heats up. Since the center pane 8 has a tin dioxide layer 20 on its outside, it preferentially radiates heat back into the intermediate space toward inner pane 10. A multiple reflection of heat takes place between the angled center pane 8 and the inner pane 10, which is finally conducted into the lower part of the frame 14/16, as this is indicated by the radiation path 24 shown as an example. In addition, there is also a heat transfer between panes 10 and 8 by convection and conduction of heat through the air in the intermediate space.

The partially heated center pane 8 radiates a part of the heat into the outer intermediate space to the outer pane 6. Since the outer pane 6 has an inner coating 22 of tin dioxide, the majority of the heat radiation is radiated back into the intermediate space between the outer and the center pane. There is also a multiple reflection in this intermediate space because of the angling of the center pane 8, which is indicated by the radiation path 26 shown as an example. Because of the fact that the center and outer pane converge toward the top, a heat conduction by multiple reflection into the upper part of the frame 14/16 takes place. In addition, the expansion of this intermediate space toward the top also favors the conducting of heat into the upper part of the frame by convection. Because of this arrangement, the outer pane 6 experiences only a reduced heating.

It should particularly be noted that the multiple reflection that is not perpendicular not only has the advantage that overall heat is conducted laterally into the window frame, but also the advantage that overheating in concentrated points on the panes that can develop through multiple perpendicular reflections is prevented and thus a more uniform temperature distribution can be achieved over the panes and in particular the outside pane.

Figure 2:
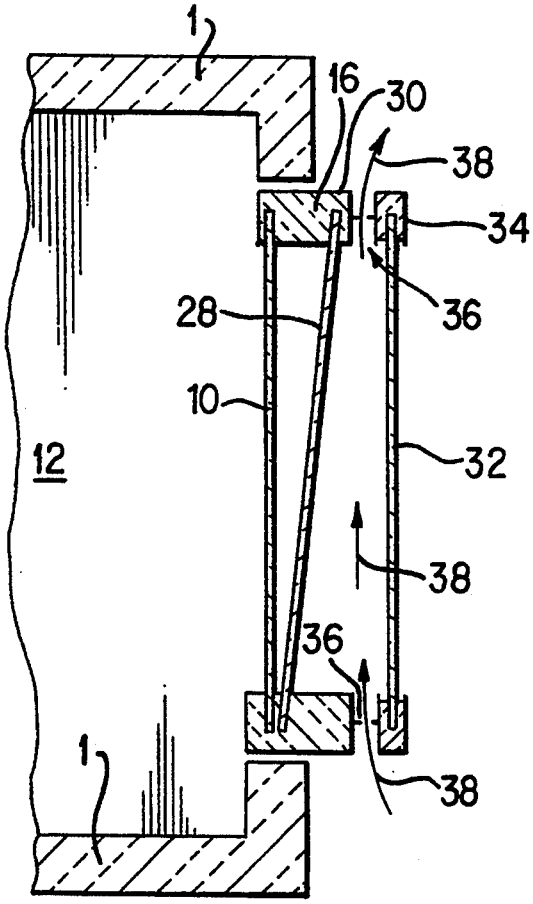
FIG. 2 is a schematic section through a modified layout of a three-pane window, in which an angled center pane converges toward the outer pane at the top and in which the intermediate space between these panes is ventilated to the outside

FIG. 2 shows an arrangement of a three-pane window, in which the inner pane 10 and a center pane 28 are held together in a frame 30, while an outer pane 32 is arranged by means of a bracket at a defined distance from the frame 30 so that, at least on the top and bottom, there are passages 36 through which the outside air can circulate, which is indicated by arrows 38. The center pane 28 is angled in such a way that it converges toward the outer pane 32 at the top. In this way, the intermediate space between these panes gets narrower at the top and the air circulation is improved by the chimney effect thus created. Also with this embodiment, the panes can be provided with infrared-reflecting coatings, however these are not indicated in the drawing.

Figure 3:
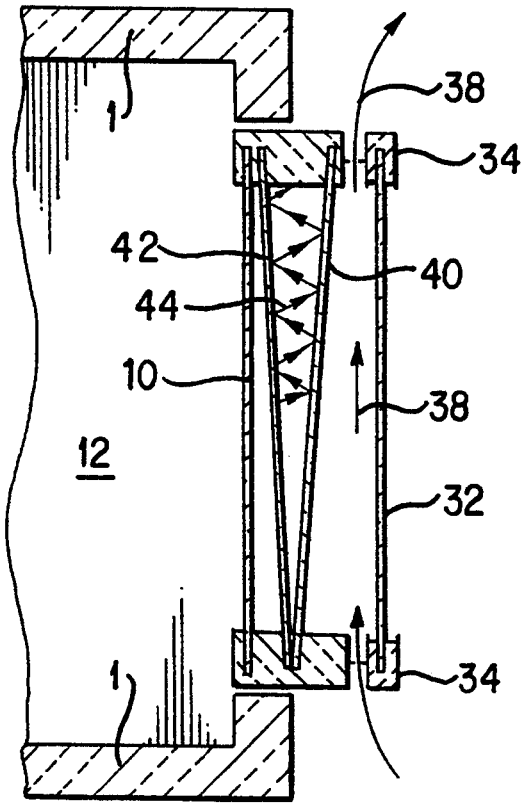
FIG. 3 is a schematic section through a four-pane layout.

Finally, FIG. 3 shows the cross section through a four-pane arrangement with an inner pane 10, an outer pane 32 and two center panes 40 and 42 that diverge at the top. The outer pane 32 is again, as in the arrangement according to FIG. 2, placed out front of the center pane 40 at a distance by means of bracket 34, in order to permit circulation of the outside air through the intermediate space between these two panes. In contrast to the arrangement in FIG. 2, however, here two angled center panes 40 and 42 are provided, that diverge at the top and in this way permit heat to be conducted into the upper part of the frame by multiple reflection, as is indicated by the radiation path 44 shown as an example. The expansion of this space between the two center panes 40 and 42 toward the top also promotes heat conduction by convection.

In the following, two more embodiment examples will be reproduced with measurements that were actually made:

EXAMPLE 1

In a laboratory test oven, a window with a three-pane arrangement according to FIG. 1 and a pane surface of approx. 500×500 mm was used. The distance between the outer pane 6 and the inner pane 10 was 40 mm. In the test, a center pane that diverged toward the outer pane was mounted between the inner and outer pane with about 4.5° angle of inclination. As a blind test, a corresponding arrangement was tested in which the center pane was mounted in the center between the inner and outer pane and parallel to them. All panes were made of the transparent glass ceramic Robax, the inner pane had a thickness of 3 mm, the center pane and the outer pane a thickness of 4 mm each. The inner pane was not coated, the center pane had a fluoridated tin dioxide coating turned toward the outside and the outer pane a corresponding coating turned toward the inside.

At one temperature in the oven interior, in the test arrangement with angled center pane an outer temperature of 30° C. was measured at the outer pane, while the outer temperature at the outer pane under the same conditions but using parallel panes was 57° C.

At an oven chamber temperature of 400° C., the temperature of the outer pane was 90° C. with the use of an angled pane, and with parallel panes was 110° C.

EXAMPLE 2

In this test, a standard commercial household baking oven was used that was provided with a window with a three-pane arrangement, whereby the distance between the inner and outer pane was 20 mm. The pane size was approx. 175 mm×350 mm. The inner pane consisted of the material Stopsol with a thickness of 4 mm, the two outer panes of Thermax 32, each also having a thickness of 4 mm. The center pane was provided with an IR reflecting coating turned toward the outside. In comparison to the standard arrangement, the center pane was installed at an angle of about 6.5° corresponding to the embodiment in FIG. 1.

At a baking chamber temperature of 300° C. that was set with the regulator provided with the baking oven, an outside pane temperature of 95° C. resulted with parallel panes, and an outer pane temperature of 90° C. with the arrangement with the angled center pane.

When the baking oven is set to the "pyrolysis" setting, an outside window temperature of 175° C. was reached with parallel pane arrangement, with the arrangement with angled center pane, a temperature of 150° C. was measured at the outside pane.

From the examples, it can be seen that temperature decreases between 5° and 27° C. at the outer pane can be achieved by depending on the variations and other conditions; a significant amount in order to be able to achieve, in connection with other measures, outside temperatures of oven windows that are safe to the touch.

We claim:

1. Window for a device with an interior chamber having an elevated interior temperature, in particular for a household roasting or baking oven, with an arrangement of at least three substantially flat surface panes of glass, glass ceramic or a corresponding transparent and temperature-resistant material, positioned at a distance from each other and generally held by a common frame, characterized by the fact that said three panes of the window include an inner pane, an outer pane and a center pane, the center pane being at an acute angle with said inner and outer panes.

2. Window according to claim 1, characterized by the fact that at least two panes (6, 8) form the acute angle to each other in a vertical direction.

3. Window according to claim 1, characterized by the fact that the acute angle is between 0.5° and 10°.

4. Window according to claim 3, characterized by the fact that the acute angle is between 2° and 6°.

5. Window according to claim 2, characterized by the fact that the angled inner pane (28) converges toward the base pane (32) toward the top.

6. Window according to claim 1, with four or more panes, characterized by the fact that it has two angled inner panes (40, 42) of which the angles of inclination to each other are opposing.

7. Window according to claim 1, including means for circulating ambient air between said center and outer panes.

8. Window according to claim 1, characterized by the fact that at least one of the panes is provided with a coating (20, 22) that better reflects heat radiation and/or has reduced heat radiation emission.

9. A window for an oven having an interior chamber, the window comprising three substantially flat surface panes of a transparent and temperature resistant material, the three panes being spaced from one another and held in position by a common frame, said three panes including an inner pane, an outer pane and a center pane, the center pane being at an acute angle with said inner and outer panes.

10. The window of a claim 9, wherein the inner and outer panes are substantially parallel and the center pane being angled with respect to both the inner and outer panes.

11. The window of claim 10, wherein the inner pane and center pane are held together by a common frame and the outer pane is arranged by means of a bracket at a predetermined distance from the frame to provide passages through which outside air can circulate.

12. The window of claim 9, further comprising a second center pane that is angled with respect to the inner and outer panes and angles with respect to the other center pane.

13. The window of claim 12, wherein the inner pane and both center panes are mounted in a common frame and the outer pane is mounted at a predetermined distance from the frame to provide passages through which outside air can circulate.

14. The window of claim 9, wherein the acute angle is between 0.5° and 10°.

15. The window of claim 9, wherein the acute angle is between 2° and 6°.

* * * * *